US011482391B2

(12) United States Patent
Marlin et al.

(10) Patent No.: US 11,482,391 B2
(45) Date of Patent: Oct. 25, 2022

(54) PYROTECHNIC CUT-OFF DEVICE

(71) Applicant: ARIANEGROUP SAS, Les Mureaux (FR)

(72) Inventors: Frédéric Marlin, Le Haillan (FR); Romain Lorenzon, Le Haillan (FR); Lun Brevet, Le Haillan (FR); Philippe Lopez, Le Haillan (FR)

(73) Assignee: ARIANEGROUP SAS, Les Mureaux (FR)

( * ) Notice: Subject to any disclaimer, the term of this patent is extended or adjusted under 35 U.S.C. 154(b) by 0 days.

(21) Appl. No.: 17/597,768

(22) PCT Filed: Jul. 21, 2020

(86) PCT No.: PCT/FR2020/051315
§ 371 (c)(1),
(2) Date: Jan. 21, 2022

(87) PCT Pub. No.: WO2021/014088
PCT Pub. Date: Jan. 28, 2021

(65) Prior Publication Data

US 2022/0262587 A1 Aug. 18, 2022

(30) Foreign Application Priority Data

Jul. 25, 2019 (FR) ..... 1908466

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC . H01H 39/00; H01H 39/006; H01H 2039/008
See application file for complete search history.

(56) References Cited

U.S. PATENT DOCUMENTS 3,264,438 A * 8/1966 Gay ..... H01H 39/00 337/403
4,385,216 A * 5/1983 Cinquin ..... H01H 9/106 200/61.08

(Continued)

FOREIGN PATENT DOCUMENTS

DE 102017011632 A1 6/2019
FR 2471662 A1 6/1981

(Continued)

OTHER PUBLICATIONS

International Search Report issued in International Application PCT/FR2020/051315 dated Nov. 10, 2020, with English Translation (6 pages).

(Continued)

*Primary Examiner* — Jacob R Crum
(74) *Attorney, Agent, or Firm* — Bookoff McAndrews, PLLC

(57) ABSTRACT

A pyrotechnic cut-off device includes: a pyrotechnic igniter, a conductive portion and a movable piston, the piston being able to be displaced in a cavity along a direction of displacement following the actuation of the pyrotechnic igniter between a first position of passage of the current in the conductive portion and a second position of cut-off of the current, wherein the piston defines a first sealing portion having a narrowing of section along the direction of displacement, and the cavity has a wall defining a second sealing portion which extends on either side of the conductive portion and which has a narrowing of section along the direction of displacement, the first sealing portion being in contact with the second sealing portion along a contact surface extending on either side of the conductive portion when the piston is in the second position.

9 Claims, 6 Drawing Sheets

(56) References Cited

U.S. PATENT DOCUMENTS

| | | | | |
|---|---|---|---|---|
| 6,556,119 | B1 * | 4/2003 | Lell | H01H 37/323 337/182 |
| 2004/0113745 | A1 * | 6/2004 | Lell | H01H 39/006 337/157 |
| 2010/0218659 | A1 * | 9/2010 | Ukon | B23D 15/145 83/639.1 |
| 2014/0326122 | A1 * | 11/2014 | Ukon | B23D 15/145 83/468.1 |
| 2016/0351363 | A1 * | 12/2016 | Gaudinat | B60L 3/04 |
| 2017/0229267 | A1 * | 8/2017 | Lell | H01H 3/222 |

FOREIGN PATENT DOCUMENTS

| | | | |
|---|---|---|---|
| FR | 3005200 | A1 | 10/2014 |
| FR | 3017240 | A1 | 8/2015 |
| WO | 2016/038043 | A1 | 3/2016 |
| WO | 2016/038050 | A1 | 3/2016 |

OTHER PUBLICATIONS

French Search Report issued in FR 1908466 dated Mar. 16, 2020 (2 pages).
Written Opinion issued in International Application PCT/FR2020/051315 dated Nov. 10, 2020, with English Translation (10 pages).

* cited by examiner

[Fig. 1]
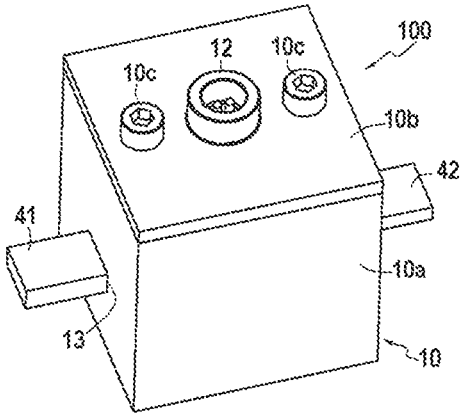
[Fig. 2]
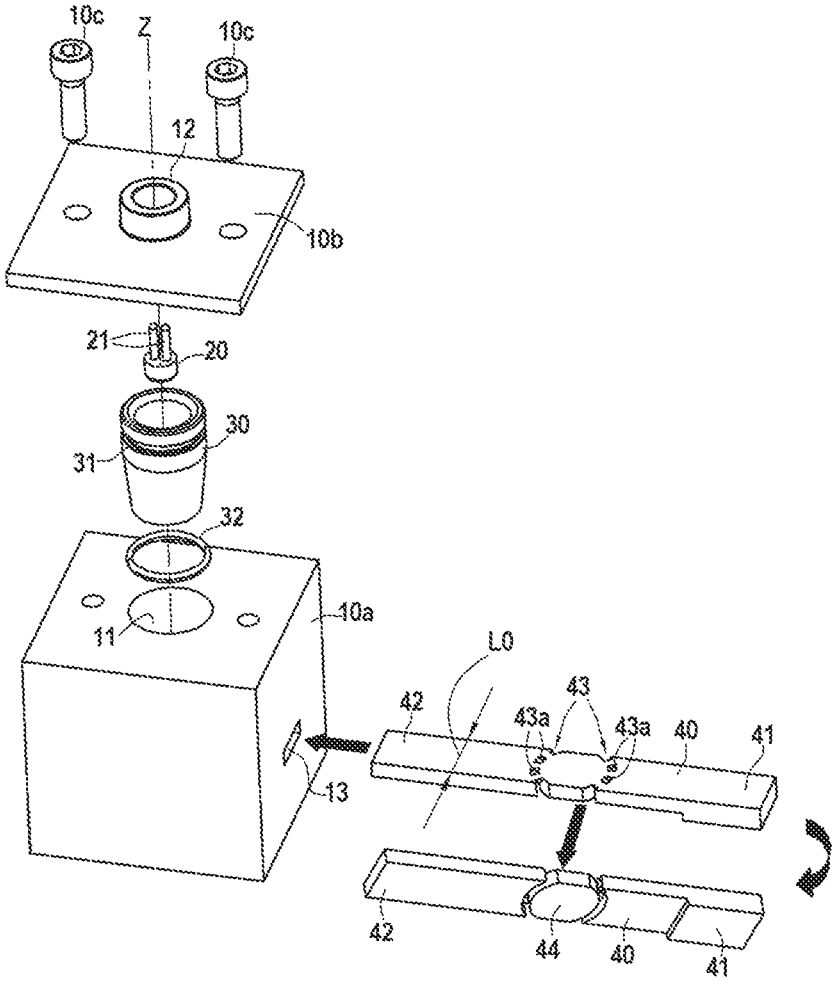

[Fig. 3]
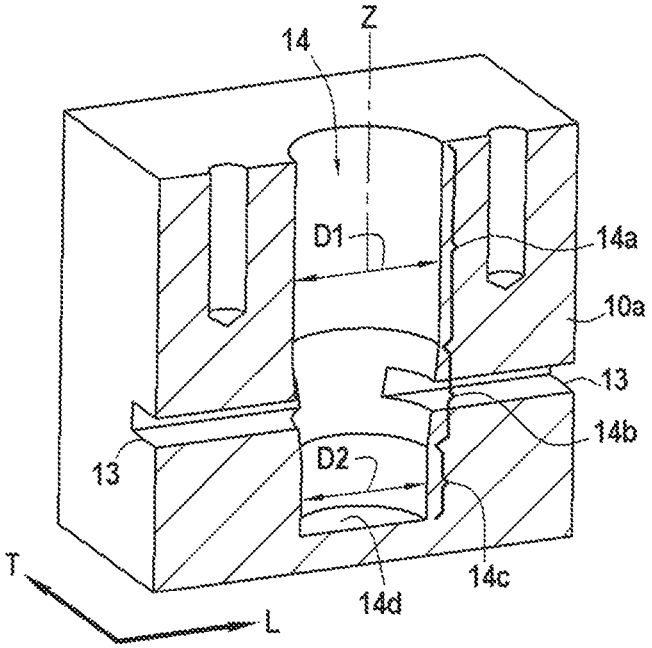
[Fig. 4]
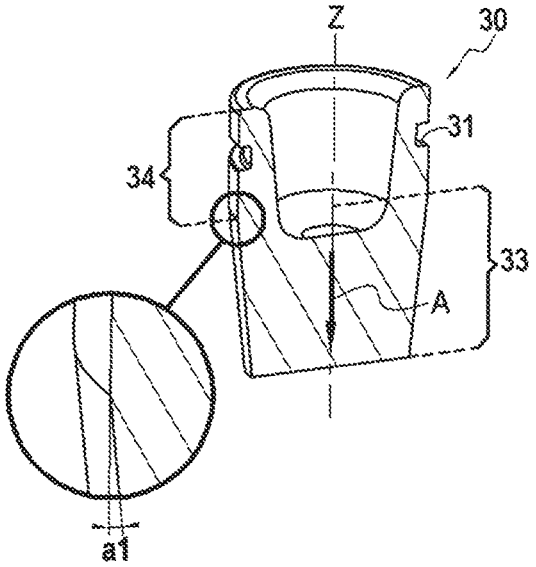

[Fig. 5A]
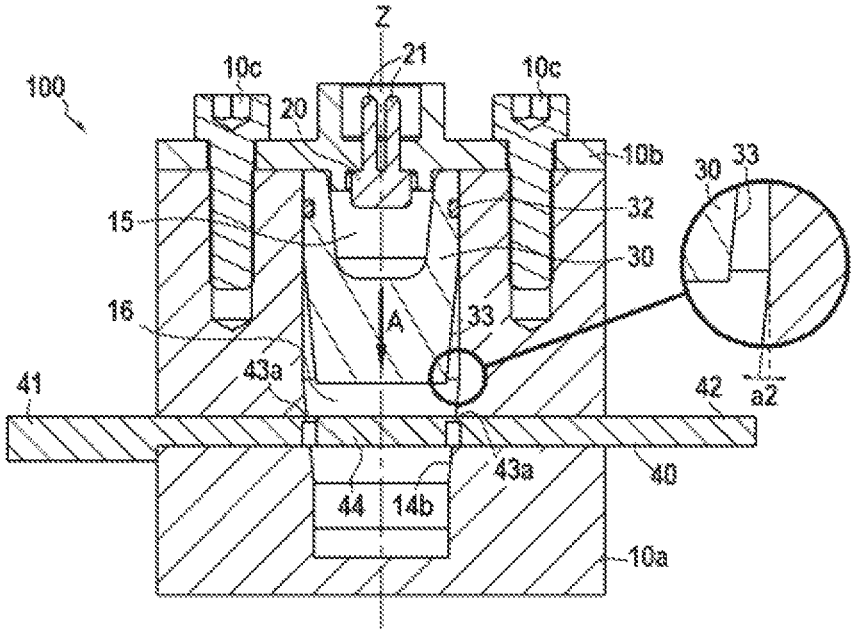
[Fig. 5B]
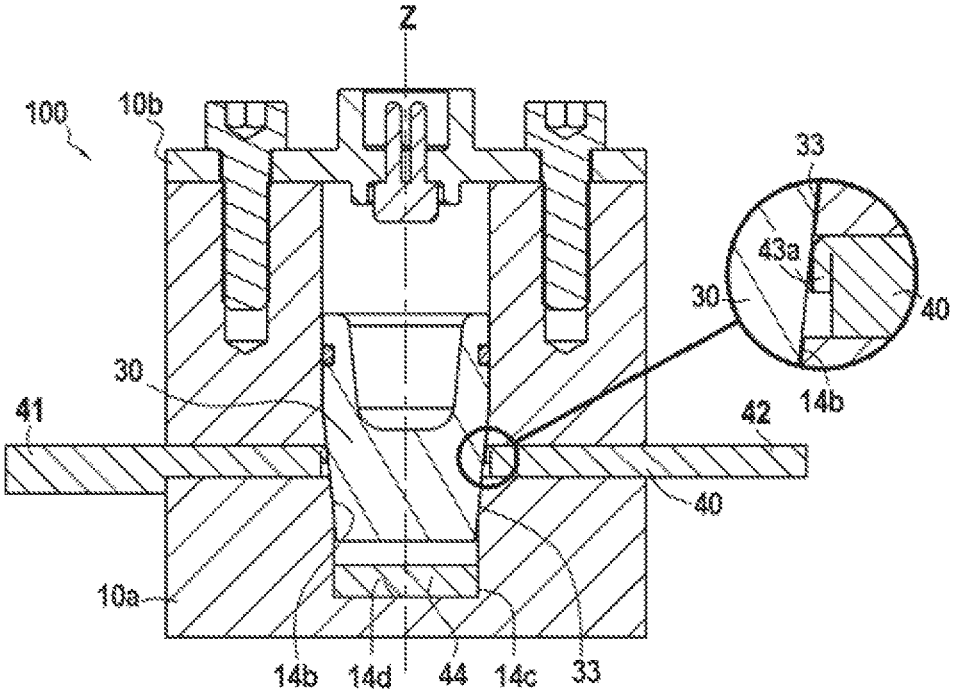

[Fig. 6]
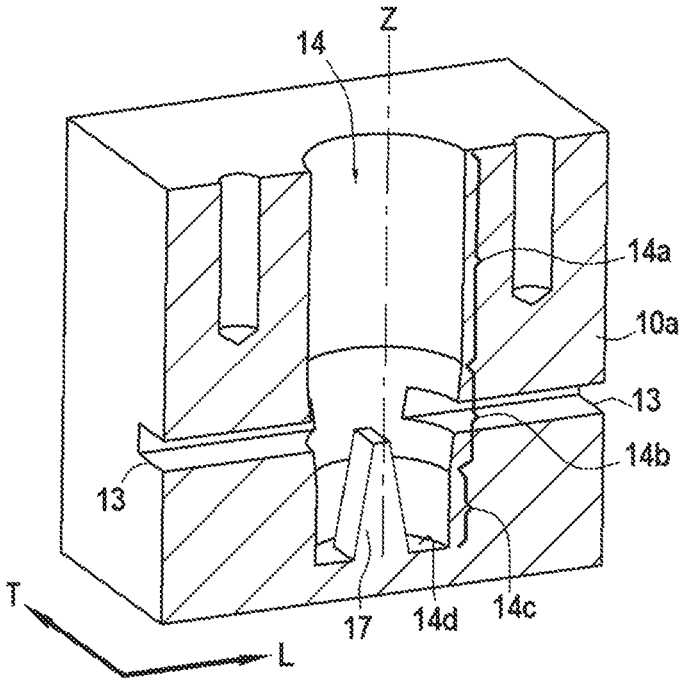
[Fig. 7]
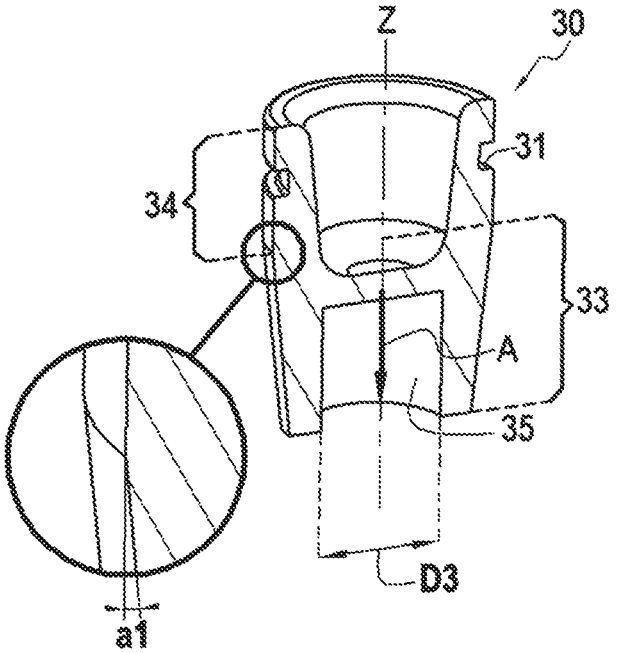

[Fig. 8A]
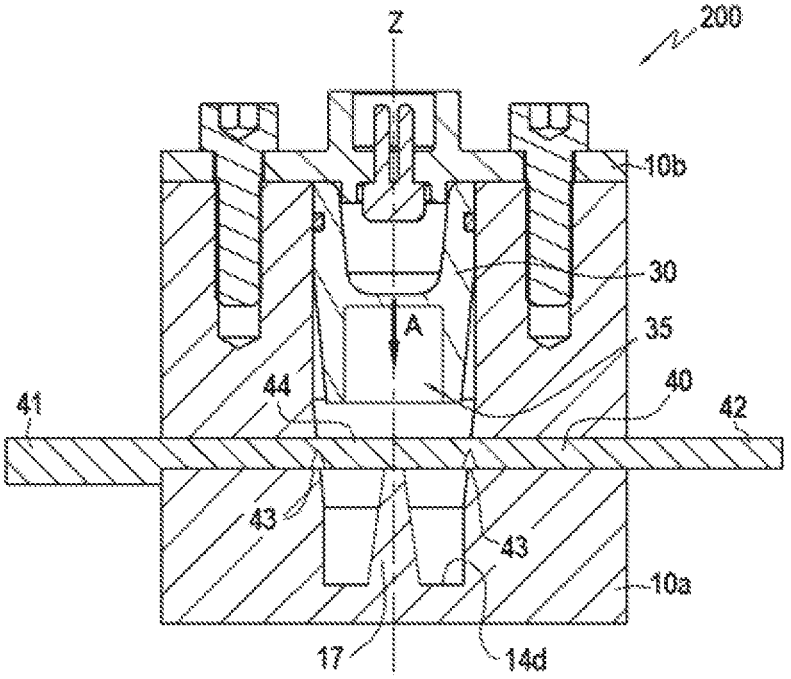
[Fig. 8B]
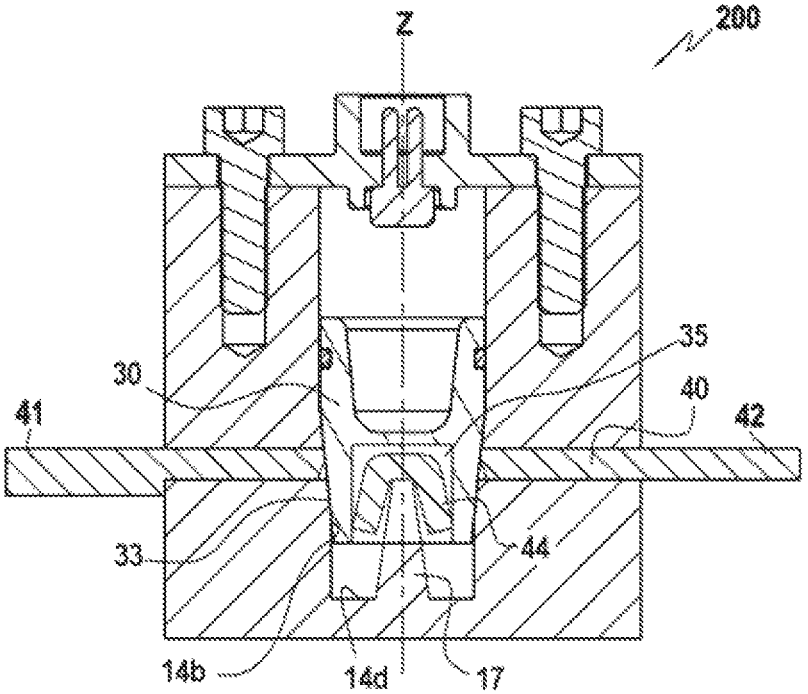

[Fig. 9]
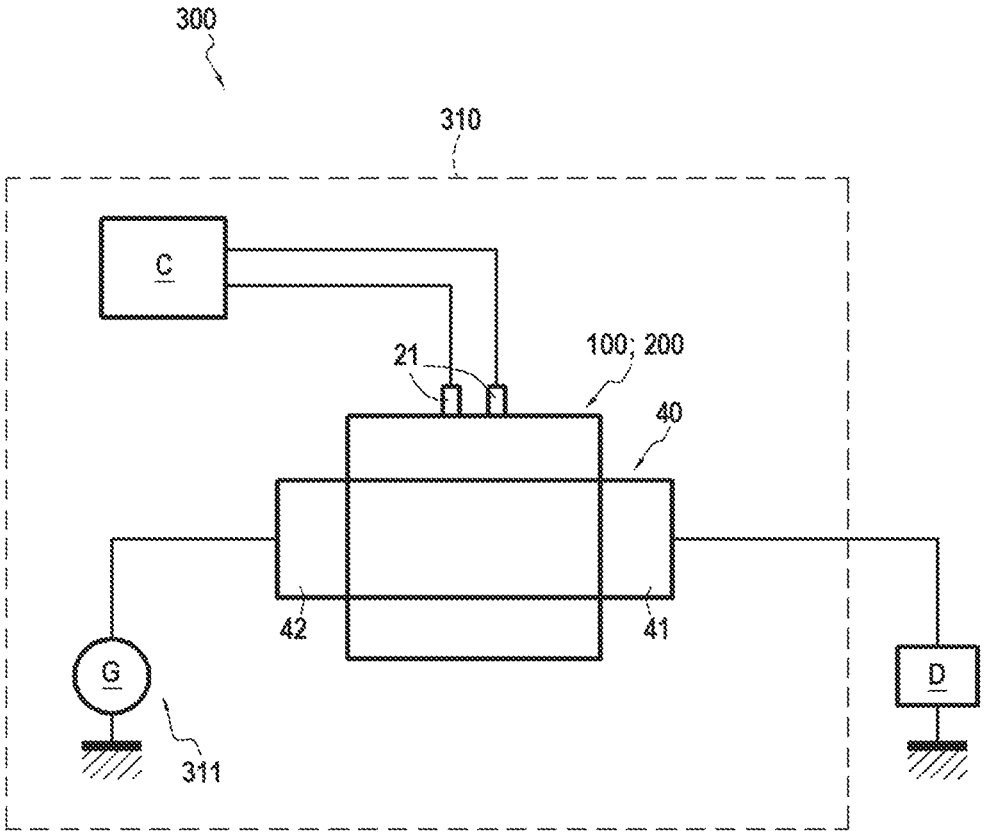

PYROTECHNIC CUT-OFF DEVICE

CROSS-REFERENCE TO RELATED APPLICATION(S)

This patent application is the U.S. National Phase Entry under 35 U.S.C. § 371 of International Application No. PCT/FR2020/051315, filed on Jul. 21, 2020, which claim priority to French Patent Application No. 1908466, filed on Jul. 25, 2019.

TECHNICAL FIELD

This invention relates to the general field of electrical cut-off devices, and more particularly those of pyrotechnical actuation type.

PRIOR ART

Pyrotechnic cut-off devices are known comprising a body in which a pyrotechnic igniter is present, configured to, when triggered, set in motion a piston equipped with a relief in the direction of a bus bar to be cut. The documents WO 2016/038043 and WO 2016/038050 show examples of devices of this type.

Known devices make it possible to obtain satisfactory results on cut-off on low-voltage circuits. However, as soon as the operating voltage increases, the reliability of known cut-off devices decreases and the cut-off time increases.

There is thus still a need for a pyrotechnical cut-off device that is more reliable at high voltages while being of a simple and economical design.

SUMMARY OF THE INVENTION

For this purpose, the invention makes provision for a pyrotechnic cut-off device comprising: a pyrotechnic igniter, a conductive portion and a movable piston, the piston being able to be displaced in a cavity along a direction of displacement following the actuation of the pyrotechnic igniter between a first position of passage of the current in the conductive portion and a second position of cut-off of the current. The cut-off device is characterized in that the piston defines a first sealing portion having a narrowing of section along the direction of displacement, and in that the cavity has a wall defining a second sealing portion which extends on either side of the conductive portion and which has a narrowing of section along the direction of displacement, the first sealing portion being in contact with the second sealing portion along a contact surface extending on either side of the conductive portion when the piston is in the second position.

The first sealing portion of the piston and the second sealing portion defined by the cavity wall can cooperate in the second position of the piston such as to create a surface seal on either side of the conductive portion, which makes it possible to separate in a sealed manner the two terminals of the device between which the conductive portion extends. Thus, the cutting of the current and the reliability of the device are improved. Furthermore, the narrowing of section of the sealing portions allow the nesting of the piston in the cavity in the manner of a Morse taper or fitting taper, which makes it possible to center the piston in the cavity, to prevent the piston from moving once it is in the second position and to thus ensure the maintaining of this seal.

When the current is cut off by cutting of the conductive portion by the piston, the device according to the invention makes it possible to obtain a characteristic weak cutoff time, corresponding to the time separating the moment where the conductive portion is cut off from the moment where the current is actually cut off, which can generally be between 50 μs and 150 μs.

In an exemplary embodiment, the sections of the piston and of the cavity can be of circular or oblong shape. These shapes with rounded sections improve the sealing between the piston and the wall of the cavity.

In an exemplary embodiment, the conductive portion can be broken by impact with the piston when it passes from the first to the second position. In particular, the conductive portion can be broken into three parts, one of which is driven by the piston.

In an exemplary embodiment, the conductive portion can have at least one fragile area to facilitate the breaking of said conductive portion. The fragile area can for example comprise a plurality of tabs, or else at least one groove.

In an exemplary embodiment, the first sealing portion can have a first surface and the second sealing portion can have a second surface, said surfaces each forming an angle between 1° and 10° with the direction of displacement of the piston. In particular, the angles made by the first surface and the second surface can be different to allow the nesting of one sealing portion in the other, in order to further improve the sealing.

In an exemplary embodiment, the hardness of the material forming the first sealing portion and the hardness of the material forming the second sealing portion can be different. The difference in hardness between said materials may be between 50 Shore A and 100 Shore D. This feature allows the deformation of one sealing portion with respect to the other when the piston passes into the second position, which further improves the sealing and the cut-off of the current.

In an exemplary embodiment, in the first position, the piston can define a housing and the device may further comprise a protrusion which extends from a floor of the cavity, said protrusion being housed in the housing when the piston is in the second position. In this configuration, the conductive portion can be cut into three parts, one of which is driven by the piston then folded against the protrusion in the housing when the piston is in the second configuration. This configuration makes it possible to improve the cut-off still further by isolating in the housing the folded part of the conductive portion of the remaining parts thereof.

The invention also relates to a secure electrical installation comprising a cut-off device such as that shown above and an electrical circuit connected to the conductive portion of said device.

The invention finally relates to a vehicle comprising a secure electrical installation such as that described above. Such a vehicle may for example be an electrical motor vehicle.

BRIEF DESCRIPTION OF THE DRAWINGS

FIG. 1 is a perspective view of a cut-off device according to a first embodiment of the invention.

FIG. 2 is an exploded view of the device of FIG. 1.

FIG. 3 is a section and perspective view of a part of the body of the cut-off device of FIG. 1.

FIG. 4 shows a section and perspective view of the piston of the cut-off device of FIG. 1.

FIGS. 5A and 5B respectively show section views of the cut-off device of FIG. 1 when the piston is in the first and in the second position.

FIG. 6 is a section and perspective view of a part of the body of a cut-off device according to a second embodiment of the invention.

FIG. 7 is a section and perspective view of the piston of the cut-off device according to the second embodiment of the invention.

FIGS. 8A and 8B respectively show section views of the cut-off device according to the second embodiment of the invention when the piston is in the first and in the second position.

FIG. 9 shows a secure electrical circuit in which is present a cut-off device according to the invention.

DESCRIPTION OF THE EMBODIMENTS

The cut-off device 100 according to a first embodiment illustrated in FIGS. 1 to 5B comprises: a body 10 in two parts 10*a* and 10*b*, a pyrotechnic igniter 20, a piston 30, and a conductive portion 40.

The device 100 comprises a first 41 and a second 42 electrical terminals intended to be connected to an electrical circuit to be cut and which here correspond to two ends of the conductive portion 40. The conductive portion 40 here takes the form of a bus bar or conductive tab. In a non-illustrated embodiment, the device 100 may comprise a plurality of conductive portions. An example of an installation comprising an electrical circuit connected to the terminals 41 and 42 will be described in relation to FIG. 9.

The body 10 has a generally parallelepipedal shape. The body 10 comprises a part 10*a* housing the different elements of the device 100 and a cover 10*b* which then closes the body 10 at an upper end. The cover 10*b* is attached to the part 10*a* by screws 10*c*. The part 10*a* of the body 10 has an upper opening 11 into which the piston 30 can be inserted. The cover 10*b* has an opening 12 to allow connectors 21 of the pyrotechnic igniter 20 to pass. The part 10*a* of the body 10 has two lateral openings 13 into which the conductive portion 40 can be inserted.

The pyrotechnic igniter 20 comprises a pyrotechnic charge connected to the connectors 21. The pyrotechnic charge is, when ignited, for example, using a current traversing the connectors 21, able to generate a pressurization gas by its combustion. The conductive elements 21 can be connected to a control device C (FIG. 9) configured to actuate the pyrotechnic igniter 20 when an anomaly is detected.

The piston 30 has, in this example, the shape of a revolution solid about an axis Z. The axis Z corresponds to the axis of displacement of the piston 30. The axis Z is transverse, for example perpendicular, in the direction of passage of the current in the conductive portion 40. The piston 30 comprises a circumferential groove 31 in which a seal 32, for example an O-ring, is intended to be housed. The piston 30 can be displaced in a direction of displacement A along the axis Z inside the body 10 between a top position (first position) as in FIG. 5A, and a bottom position (second position) as in FIG. 5B. The direction of displacement A is oriented from the pyrotechnic igniter 20 toward the conductive portion 40 or toward the second sealing portion 14*b* (downward in the illustrated example). As long as the pyrotechnic igniter 20 has not been triggered, the piston 30 is in the first position.

The piston 30 comprises a first sealing portion 33, here corresponding to a lower part of the piston, which has a narrowing of section along the direction of displacement A of the piston 30. The first sealing portion 33 here corresponds to one end of the piston 30 facing the conductive portion 40. In this example, the first sealing portion 33 is of frustoconical shape, for example of circular section. The angle a1 formed by the surface of the first sealing portion 33 with the direction of displacement of the piston A may be between 1° and 10°. The angle a1 can be measured in a plane containing the direction of displacement A (or the axis Z). In a variant, the piston could have other sections, for example of oblong, or else square shape. The upper part 34 of the piston in which the groove 31 is present is meanwhile of cylindrical shape here.

The body 10 defines a cavity 14 in which the piston 30 can be displaced and which is traversed by the conductive portion 40. The cavity 14 is here divided into three parts; an upper part 14*a* where the wall of the cavity 14 is of generally cylindrical shape, a second sealing portion 14*b* where the wall has a narrowing of section in the direction of displacement A of the piston 30, and a lower part 14*c* where the wall of the cavity is of generally cylindrical shape. The second sealing portion 14*b* extends the upper part 14*a*, and the lower part 14*c* extends the second sealing portion 14*b*. In this example, the second sealing portion 14*b* has a frustoconical shape. In this example, the inner diameter D1 of the cavity 14 at the level of the upper part 14*a* is greater than the inner diameter D2 of the cavity at the level of the lower part 14*c*, and the inner diameter of the cavity at the level of the second sealing portion 14*b* gradually decreases between the upper part 14*a* and the lower part 14*c*. The second sealing portion 14*b* extends on either side of the conductive portion 40, i.e. here on either side of the openings 13 which open into the cavity 14. The second sealing portion 14*b* has a surface which forms an angle a2 with the direction of displacement A of the piston 30 which can be between 1° and 10°. The angle a2 can be measured in a plane containing the direction of displacement A (or the axis Z). The angle a1 and the angle a2 may be identical or be slightly different. For example, the angle a1 can be of 3° and the angle a2 can be of 4°, or conversely.

The section of the cavity 14 and its dimensions will be adapted to those of the piston 30 so that the latter can be displaced in order to cut the conductive portion 40, and the sealing portions 33 and 14*b* of the piston and of the cavity wall can cooperate in the second position, i.e. be in contact along a contact surface extending on either side of the conductive portion 40.

The conductive portion 40 has, in this example, two fragile areas 43 (FIG. 2) which facilitate the cut-off of the conductive portion 40 by the piston 30. In this example, each fragile area 43 has a plurality of mutually spaced tabs 43*a* which connect each terminal 41 and 42 of the conductive portion 40 to a part 44 which is intended to be separated from the terminals 41 and 42 and driven by the piston. Other types of fragile areas may be envisioned, for example grooves made in the conductive portion 40. In this example, the conductive portion 40 is cut into three parts by the piston 30. The conductive portion 40 has a width LO. In a variant, other cut-off configurations may be envisioned.

When the piston 30 is in the cavity 14, it separates the cavity 14 into a first pressurization chamber 15 and a second chamber 16 in which the conductive portion 40 is present.

In the illustrated examples, the conductive portion 40 is separate from the body 10*a*. In a variant, the conductive portion 40 can be overmolded with the body 10 (here the part 10*a*) such as to improve the sealing between the conductive portion 40 and the body 10.

The different operating steps of the device 100 will now be described in relation to FIGS. 5A and 5B which show section views thereof, respectively when the piston 30 is in the first position and in the second position.

FIG. 5A shows the device 100 before its triggering. After the triggering of the pyrotechnic igniter 20, the chamber 15 is pressurized by the gas coming from the combustion of the pyrotechnic charge, and the piston 30 is set in motion toward the conductive portion 40 until the first sealing portion 33 of the piston 30 then strikes the conductive portion 40. More precisely, the first sealing portion 33 of the piston 30 then strikes the part 44 of the conductive portion 40 which then becomes detached from the parts of the conductive portion 40 connected to the terminals 41 and 42. During the passing of the piston 30, the tabs 43*a* can then fold as can be seen on the magnification of FIG. 5B to avoid impeding the stroke of the piston 30.

When the piston 30 is in the second position or bottom position as in FIG. 5B, its first sealing portion 33 is in surface contact with the second sealing portion 14*b* of the cavity 14. In the second position, the piston 30 is interposed between the openings 13. In the second position, the piston 30 is interposed between the terminals 41 and 42 of the cut-off device. In the second position, the piston 30 is interposed between the fragments of the broken conductive portion 40. The piston 30, in the second position, covers the openings 13 which open into the cavity. The contact surface between the piston 30 and the wall of the cavity 14 extends on either side of the initial location of the conductive portion 40 (or equivalently, on either side of the openings 13) such as to create a seal preventing the passage of the current between the terminals 41 and 42. This contact surface can have a frustoconical shape. In this example, the whole surface of the second sealing portion 14*b* is in contact with the first sealing portion 33. In this example, the contact surface between the piston 30 and the wall of the cavity 14 surrounds the openings 13 which open into the cavity 14. In this way, the terminals 41 and 42 are isolated from one another in a sealed manner. The contact surface between the piston 30 and the wall of the cavity 14 extends around, in particular all around (360° around) the axis of displacement Z of the piston 30. The cut part 44 of the conductive portion 40 is meanwhile housed in the lower part 14*c* of the cavity 14 on a floor 14*d* thereof.

The materials of the first sealing portion 33 of the piston 30 and of the part of the body 10 forming the second sealing portion 14*b* can be identical. As a variant, these materials may advantageously have different hardness. The difference in hardness between these materials may be between 50 Shore A and 100 Shore D. Thus, the body 10 or the piston 30 may deform when the piston 30 passes from the first to the second position which provides a still better contact between the two sealing portions, a better seal and therefore a better cut-off of the current.

FIGS. 6 to 8B show views of a cut-off device 200 according to a second embodiment of the invention. Unless otherwise specified, identical reference signs between the first and second embodiment denote identical features. With respect to the device 100, the piston 30 of the device 200 comprises a housing 35 and its cavity 14 has a protrusion 17.

The housing 35 of the piston 30 is present in the sealing portion 33 and opens facing the conductive portion 40 when the piston 30 is in the first position. In this example, the housing 35 is of cylindrical shape.

The protrusion 17 extends from a floor 14*d* of the cavity 14. In the first position, the protrusion 17 here extends more precisely between the floor 14*d* of the cavity 14 and the conductive portion 40. The protrusion 17 has a triangular section in a plane containing the conductive portion 40 and the axis of displacement A of the piston. The protrusion 17 extends along a transverse direction T with respect to the longitudinal direction L along which the conductive portion 40 extends.

In this example, the conductive portion 40 has grooves as fragile areas 43, which delimit the part 44 of the conductive portion 40 which will be separated from the terminals 41 and 42 during the cut-off.

The inner diameter D3 of the housing 35 is greater than the width LO of the conductive portion 40 such that the housing 35 can receive the part 44 after the cut-off.

The operation of the device 200 is similar to that of the device 100, with the exception that, when the piston 30 is in the second position, the part 44 of the conductive portion 40 which is cut off and driven by the piston 30 is folded by the protrusion 17 in the housing 35. In the second position, the part 44 is located between the protrusion 17 and the piston 30 in the housing 35, which makes it possible to isolate the parts 44 of the terminals 41 and 42, and to further improve the current cut-off. In particular, with this device 200, the speed of separation of the part 44 of the terminals 41 and 42 is increased, and the distance of separation between the part 44 and the terminals 41 and 42 is greater while remaining of small overall dimensions.

FIG. 9 schematically shows an example of a secure electrical installation 300 implementing a cut-off device 100 or 200 according to the invention.

The secure electrical installation 300 comprises a secure power supply system 310 comprising a cut-off device 100 or 200 (shown very schematically) and a power supply circuit 311. The power supply circuit 311 here comprises an electrical generator G connected to the second terminal 42 of the conductive portion 40 of the cut-off device 100 or 200. The electrical generator G can for example be a battery or an alternator.

The secure power supply system 310 further comprises a control element C configured to actuate the pyrotechnic igniter 20 when an anomaly is detected. The control element C is connected to the pyrotechnic igniter 20 by way of the connectors 21. The anomaly in response to which the control element C may trigger the pyrotechnic igniter 20 can be an electrical anomaly, such as a crossing of a current threshold in the circuit, or a non-electrical anomaly such as the detection of a shock, for example a sudden deceleration of the control element, a change in temperature, pressure etc. If an anomaly is detected, the control element C is able to send an electrical current to the pyrotechnic igniter 20 for its triggering in order to cut the current, as previously described.

The secure electrical installation 300 finally comprises an electrical device D here connected to the first terminal 41 of the conductive portion 40 of the cut-off device 100 or 200 to be powered by the secure power supply system 310.

By way of example, a motor vehicle may comprise a secure electrical installation 300.

The invention claimed is:

1. A pyrotechnic cut-off device comprising: a pyrotechnic igniter, a conductive portion and a movable piston, the piston being able to be displaced in a cavity along a direction of displacement following the actuation of the pyrotechnic igniter between a first position of passage of the current in the conductive portion and a second position of cut-off of the current, characterized in that the piston defines a first sealing portion having a narrowing of section along the direction of displacement, and in that the cavity has a wall defining a second sealing portion which extends on either side of the conductive portion and which has a narrowing of section along the direction of displacement, the first sealing portion being in contact with the second sealing portion along a contact surface extending on either side of the conductive portion when the piston is in the second position, the first sealing portion and the second sealing portion cooperating in the second position such as to create a surface seal on either side of the conductive portion, which makes it possible to separate in a sealed manner two terminals of the device between which the conductive portion extends.

2. The device as claimed in claim 1, wherein the sections of the piston and of the cavity are of circular or oblong shape.

3. The device as claimed in claim 1, wherein the conductive portion is broken by impact with the piston when it passes from the first to the second position.

4. The device as claimed in claim 3, wherein the conductive portion has at least one fragile area to facilitate the breaking of said conductive portion.

5. The device as claimed in claim 1, wherein the first sealing portion has a first surface and the second sealing portion has a second surface, said surfaces each forming an angle between 1° and 10° with the direction of displacement of the piston.

6. The device as claimed in claim 1, wherein a hardness of a material forming the first sealing portion and a hardness of a material forming the second sealing portion are different.

7. The device as claimed in claim 1, wherein, in the first position, the piston defines a housing and the device further comprises a protrusion which extends from a floor of the cavity, said protrusion being housed in the housing when the piston is in the second position.

8. A secure electrical installation comprising a cut-off device as claimed in claim 1, and an electrical circuit connected to the conductive portion of said device.

9. A vehicle comprising a secure electrical installation as claimed in claim 8.

* * * * *